US007138761B2

(12) United States Patent
Moon

(10) Patent No.: US 7,138,761 B2
(45) Date of Patent: Nov. 21, 2006

(54) FIELD EMISSION DISPLAY AND DRIVING METHOD THEREOF

(75) Inventor: Seong Hak Moon, Yongin (KR)

(73) Assignee: LG Electronics Inc., Seoul (KR)

( * ) Notice: Subject to any disclaimer, the term of this patent is extended or adjusted under 35 U.S.C. 154(b) by 280 days.

(21) Appl. No.: 10/245,284

(22) Filed: Sep. 18, 2002

(65) Prior Publication Data

US 2003/0098826 A1 May 29, 2003

(30) Foreign Application Priority Data

Nov. 23, 2001 (KR) ..... 2001-73223
Jan. 31, 2002 (KR) ..... 2002-5662

(51) Int. Cl.

| | |
|---|---|
| ***H01J 17/44*** | (2006.01) |
| ***H01J 17/38*** | (2006.01) |
| ***H01J 1/88*** | (2006.01) |
| ***H01J 1/90*** | (2006.01) |
| ***H01J 1/96*** | (2006.01) |

(52) U.S. Cl. ..... 313/498; 313/292; 313/346 R; 313/495

(58) Field of Classification Search ..... 313/495–504, 313/309, 310, 311, 351, 346 R, 336
See application file for complete search history.

(56) References Cited

U.S. PATENT DOCUMENTS

| | | | | |
|---|---|---|---|---|
| 5,517,075 | A * | 5/1996 | Vickers | 313/336 |
| 5,543,683 | A * | 8/1996 | Haven et al. | 313/461 |
| 5,614,781 | A * | 3/1997 | Spindt et al. | 313/422 |
| 5,859,508 | A * | 1/1999 | Ge et al. | 315/366 |
| 5,896,001 | A * | 4/1999 | Shishido | 313/461 |
| 2002/0185963 | A1 * | 12/2002 | Browning et al. | 313/495 |

FOREIGN PATENT DOCUMENTS

JP 10188861 A * 7/1998

OTHER PUBLICATIONS

JPO Computer translation of Nakamura et al (JP 10188861 A).*

* cited by examiner

*Primary Examiner*—Nimeshkumar D. Patel
*Assistant Examiner*—Peter Macchiarolo
(74) *Attorney, Agent, or Firm*—Fleshner & Kim, LLP

(57) ABSTRACT

A field emission display device is disclosed. Since the size of the cells adjacent to the spacer is set smaller than the size of the other cells, the luminance and aperture rate of the panel can be improved. In addition, the width of the pulse supplied to the cells adjacent to the spacer and the width of the pulse supplied to the cells not adjacent to the spacer are set different, so that the same luminance can be displayed in every cell.

9 Claims, 8 Drawing Sheets

FIELD EMISSION DISPLAY AND DRIVING METHOD THEREOF

BACKGROUND OF THE INVENTION

1. Field of the Invention

The present invention relates to a field emission display, and more particularly, to a field emission display device and its driving method that are capable of improving an aperture rate of an overall panel and its luminance.

2. Description of the Background Art

Recently, various flat type display devices are being developed to reduce a weight and a volume of a cathode ray tube (CRT). Such flat type display devices include a liquid crystal display, a field emission display (FED), a plasma display panel, an electro-luminescence, or the like. In order to improve a display quality of the flat type display devices, researches are being actively conducted to heighten a luminance, a contrast and a colorimetric purity.

Among them, the FED is divided into a tip type FED in which electrons are emitted by using a tunnel effect by concentrating a high electric field to an acute emitter, and a flat type FED in which a high electric field is concentrated to a metal with a certain area to emit electrons.

In the tip type FED, electrons are emitted from a conic protrusion portion made of silicon (Si) or molybdenum (Mo) by applying a voltage to a gate electrode to apply an electric field to an electron emission portion.

In the flat type FED, a stacked structure including a metal layer, an insulation layer and a semiconductor layer is formed, wherein electrons are injected into and passes from the metal layer and then emitted outwardly from an electron emission unit.

In the tip type FED, the electron emission amount is determined depending on characteristics of the emitter used for the electron emission. Therefore, every emitter should be fabricated uniform. In this respect, however, it is difficult to fabricate the emitters uniform with the current fabrication process, and in order to fabricate such an emitter, much process time is taken.

In addition, in case of the tip type FED, since the electrons are emitted from the acute emitter, scores of or hundreds of bolt should be applied to a cathode electrode and a gate electrode, causing a problem of much power consumption.

FIG. 1 is a view showing a cell of the flat type FED in accordance with a conventional art.

As shown in FIG. 1, each cell of the flat type FED includes: an upper substrate 101 on which an anode electrode 102 and a fluorescent material 103 are stacked; an electric field emission array 105 formed on a lower substrate 104; and a spacer 109 for supporting the upper substrate 101.

The electric field emission array 105 includes: a scan electrode 108 formed on the lower substrate 104; an insulation layer 107 formed on the scan electrode 108 and a data electrode 106 formed on the insulation layer 107.

The scan electrode 108 supplies current to the insulation layer 107, the insulation layer 107 insulates the scan electrode 108 and the data electrode 106, and the data electrode 106 is used as a fetch electrode for fetching an electron.

The space 109 is installed between the upper substrate 101 and the lower substrate 104. Since a high vacuum state is required between the upper substrate 101 and the lower substrate 104 (to prevent an arcing phenomenon due to an acceleration movement of electrons and a high voltage), the spacer 109 prevents a damage of the panel caused due to a difference between an internal pressure and an external pressure (the difference between an external atmospheric pressure and an internal high vacuum is equivalent to approximately scores of tones).

The flat type field emission display device in accordance with the conventional art constructed as described above will now be explained.

In order to display an image on the display device, first, a negative (−) scan pulse is applied to the scan electrode 108 and a positive (+) data pulse is applied to the data electrode 106. And, a positive (+) anode voltage is applied to the anode electrode 102.

Then, electrons tunnel the insulation layer 107 from the scan electrode 108 to the data electrode 106 and are accelerated toward the anode electrode 102.

The electrons collide with red, green and blue fluorescent materials 103 and excite the fluorescent material 103.

At this time, a visible ray of one of the red, green and blue colors is generated according to the fluorescent material 103.

Compared with the tip type FED, the flat-type FED can be driven at a low voltage since the scan electrode 108 and the data electrode 106 are installed in a facing manner with a certain area.

That is, only a few V to 10V is applied to the scan electrode 108 and the data electrode 106 of the flat type FED, and the scan electrode 108 and the data electrode 106 emitting electrons respectively have a certain area. Thus, compared with the tip-type FED, the scan electrode 108 and the data electrode 106 can be fabricated with a simple fabrication process.

FIG. 2 is a plan view showing a field emission display device in accordance with the conventional art.

As shown in FIG. 2, the FED includes: first and second data connection parts 202*a* and 202*b* for receiving a drive voltage from a data driving unit (not shown); a scan connection part 201 for receiving a drive voltage from a scan driving unit (not shown); an anode electrode 102 for receiving a drive voltage from an anode driving unit (not shown); and a connection part 204 for electrically connecting the anode electrode 102 and the upper substrate 101.

The first and second data connection parts 202*a* and 202*b* receive the drive voltage from the data driving unit and supply it to the data electrodes, and the scan connection part 201 receives the drive voltage from the scan driving unit and supplies it to the scan electrodes.

The anode electrode 102 is formed within an effective display part 203 of the upper substrate 101, and the anode driving unit applies a few kV high voltage to the anode electrode 102 typically formed as a thin film through the connection part 204.

FIG. 3 is a plan view showing the effective display part.

As shown in FIG. 3, the effective display part 203 includes red cells, green cells and blue cells which are sequentially disposed at regular intervals, and a spacer 109 between cells.

In order to form the spacer 109, a certain space is obtained between the cells. In the region where the space 109 is not formed, the areas between cells are the same each other. Reference numeral 301 denotes an emitter electrode and 302 denotes a fluorescent material 302.

The spacer 109 is divided into a rib type and a cross type. As shown in FIG. 4, there are installed hundreds and thousands of rib type spacers 401 to support a vacuum space between the upper substrate 101 and the lower substrate 104.

Thousands of cross-type spacers 501 as shown in FIG. 5 are installed to support the vacuum space between the upper substrate 101 and the lower substrate 104.

The rib-type and cross-type spacers 401 and 501 are installed between cells (R, G and B). Thus, the cells (R, G and B) are disposed adjacent with a certain space therebetween so that the spacers 501 and 501 can be installed therein.

However, in general, cells are disposed with the certain space (in consideration of formation of the spacer) therebetween, much space loss occurs. That is, since there should be a certain space even between adjacent cells with no spacer formed therebetween, an efficiency of a panel and an aperture rate are reduced.

In addition, since the electron beam is distorted according to the quantity and the position of the spacer 109 within the effective display part 203 (a phenomenon that a proceeding direction is changed as electrons collide with the spacer 109), the brightness of the adjacent cells differs and the angle at which an electron beam spreads is changed to cause a problem that there is a difference in the brightness of a screen.

Moreover, since scores of and hundreds of spacers 109 are formed within the effective display part 203, the aperture rate between the anode electrode 102 and an emitter (not shown) (area occupied by the fluorescent material over an overall area of one cell) is restricted. Therefore, with the disposal of the spacers 109, the aperture rate of the overall panel is degraded, and accordingly, a luminance and efficiency are low.

SUMMARY OF THE INVENTION

Therefore, an object of the present invention is to provide a field emission display device that is capable of improving a luminance and an aperture rate of a panel by setting a size of cell adjacent to a spacer smaller than other cells, and its driving method.

Another object of the present invention is to provide a field emission display device that is capable of having the same luminance in every cell by setting different a pulse width supplied to a cell adjacent to a spacer and a pulse width supplied to a cell not adjacent to the spacer, and its driving method.

To achieve these and other advantages and in accordance with the purpose of the present invention, as embodied and broadly described herein, there is provided a field emission display device including: cells with different areas formed at an effective display part of a panel; and a spacer formed between the cell.

To achieve the above objects, there is also provided a field emission display device in which a size of cells adjacent to a spacer are set smaller than a size of cells not adjacent to the spacer, including: a controller for receiving a data, a vertical synchronous signal and a horizontal synchronous signal from an external source and generating first and second timing control signal; a data pulse width controller for receiving the data and the first timing control signal from the controller and generating first and second data pulse with mutually different widths; and a scan pulse width controller for receiving the second timing control signal from the controller and generating first and second scan pulse with mutually different widths.

To achieve the above objects, there is also provided a driving method of a field emission display device in which a size of cells adjacent to a spacer are set smaller than a size of cells not adjacent to the spacer, including the steps of: supplying a first scan pulse to a cell adjacent to the spacer; supplying a second scan pulse with a different width to that of the first scan pulse to the cell not adjacent to the spacer; supplying a first data pulse in synchronization with the first scan pulse; and supplying a second data pulse in synchronization with the second scan pulse.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

The field emission display device (FED) of the present invention solves problems of the conventional art by controlling the disposal of cells according to a spacer and its driving method in order to improve an aperture rate and a luminance of each cell.

Figure 1:
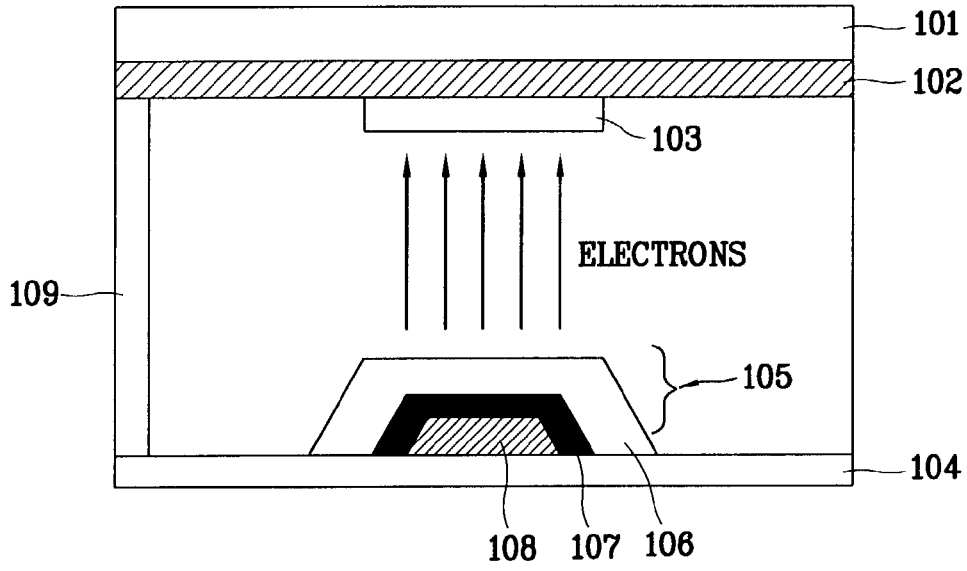
FIG. 1 CONVENTIONAL ART
FIG. 1 is a view showing a cell of a flat type FED in accordance with a conventional art.
Figure 2:
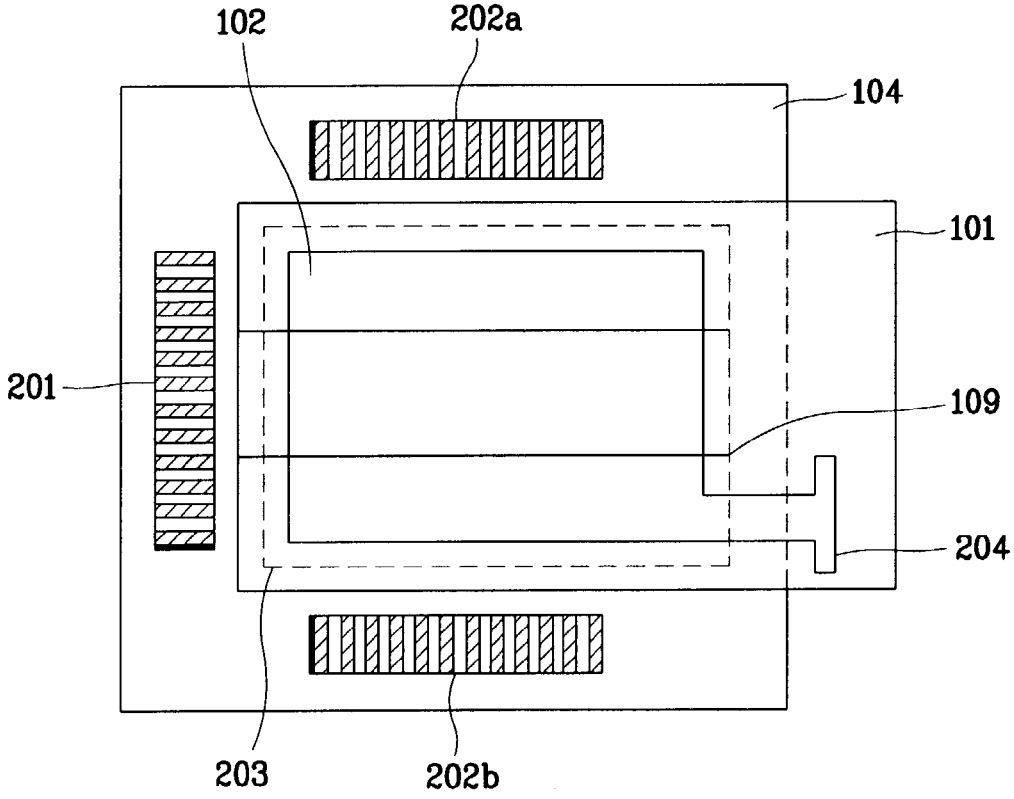
FIG. 2 CONVENTIONAL ART
FIG. 2 is a plan view showing a field emission display device in accordance with the conventional art.
Figure 3:
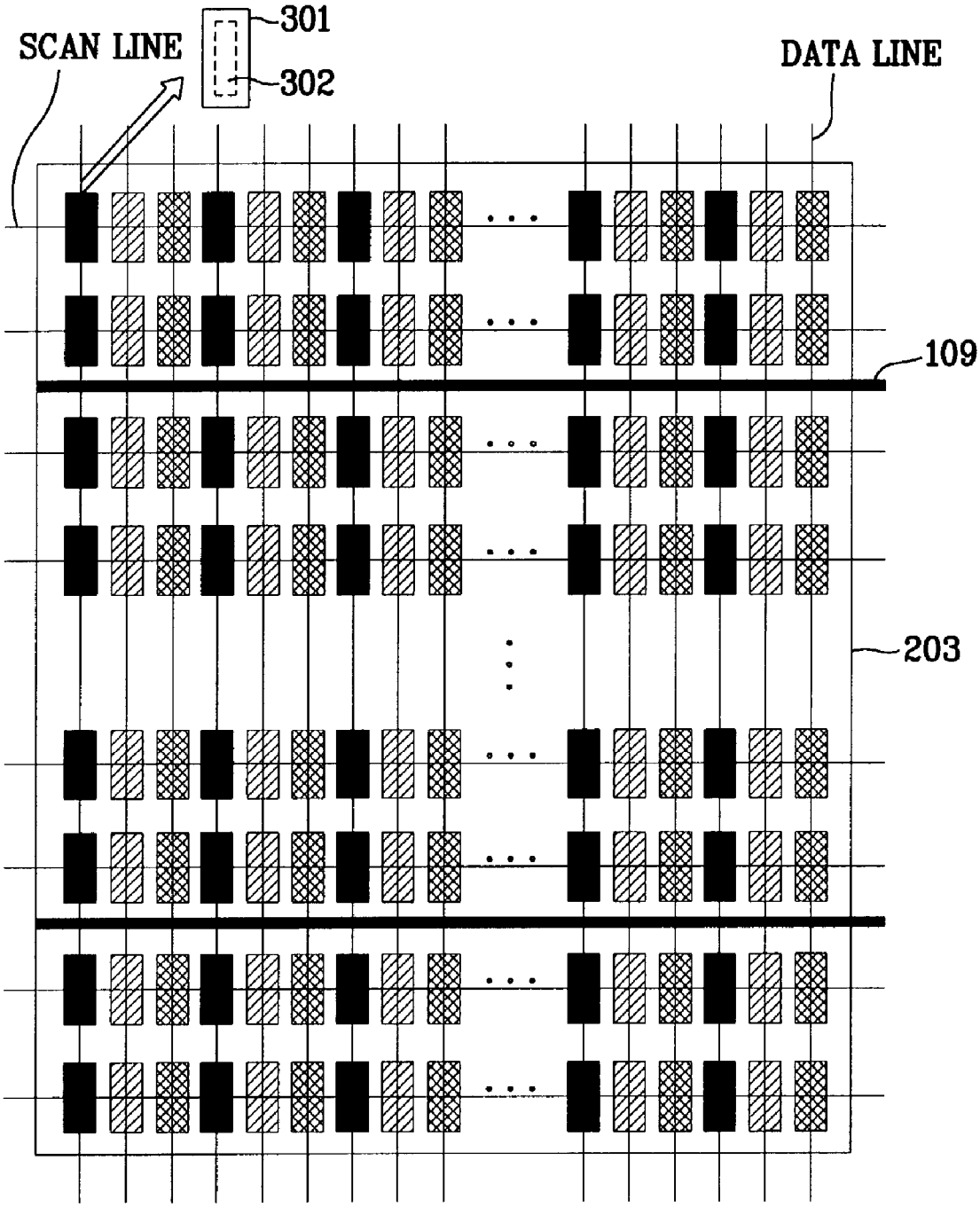
FIG. 3 CONVENTIONAL ART
FIG. 3 is a view showing an effective display part of FIG. 2.
Figure 4:
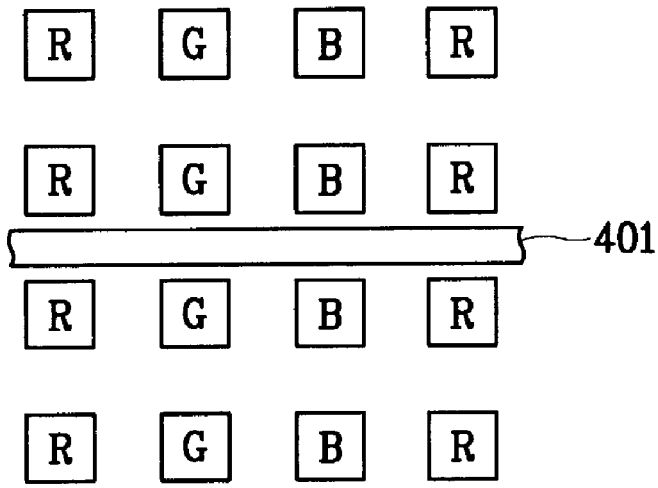
FIG. 4 CONVENTIONAL ART
FIG. 4 is a view showing a field emission display device with a rib-type spacer installed in accordance with the conventional art.
Figure 5:
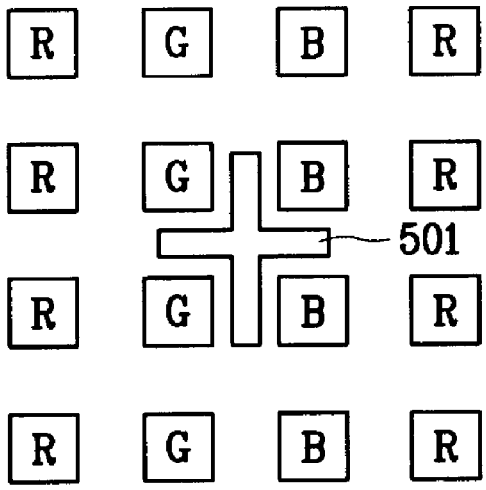
FIG. 5 CONVENTIONAL ART
FIG. 5 is a view showing a field emission display device with a cross-type spacer installed in accordance with the conventional art.
Figure 6:
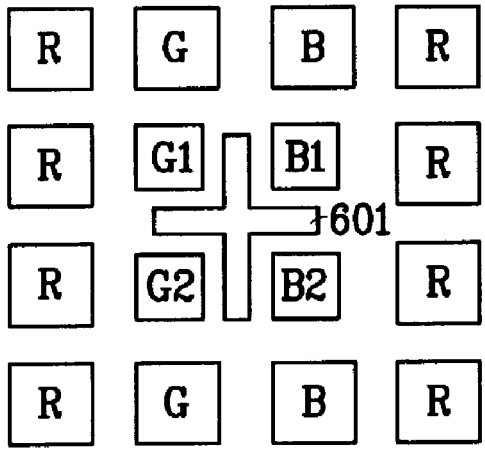
FIG. 6 is a view showing cells disposed around a cross-type spacer in accordance with a first embodiment of the present invention.

FIG. 6 is a view showing cells disposed around a cross-type spacer in accordance with a first embodiment of the present invention.

As shown in FIG. 6, in the FED, a cross-type spacer 601 is installed between cells (R, G and B). The cross-type spacer 601 maintains a vacuum space of the FED panel with the cells (R, G and B).

The size of cells (G1, B1, G2 and B2) adjacent to the cross-type spacer 601 is set smaller than the size of other cells (R, G and B). The cells (R, G and B) not adjacent to the cross-type spacer 601 are formed larger than those cells in the conventional art because they are not related to formation of the cross-type spacer 601.

Therefore, in the FED, the space between the adjacent cells (G1, B1, G2 and B2) with the cross-type spacer 601 therebetween is set larger than the space between the cells (R, G and B) not adjacent to the cross-type spacer 601, thereby improving the aperture rate and the luminance.

Figure 7:
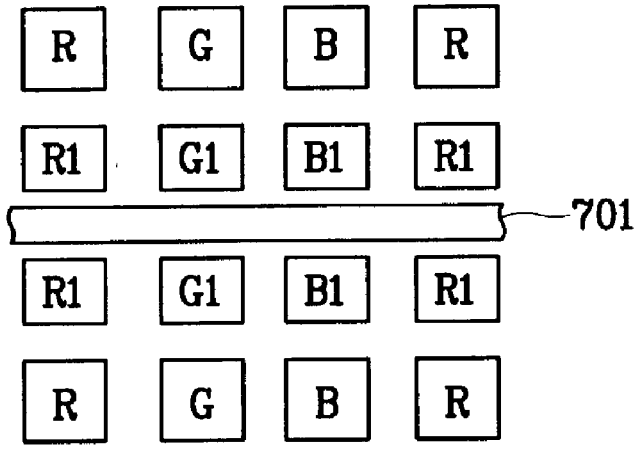
FIG. 7 is a view showing cells disposed around a rib-type spacer in accordance with a first embodiment of the present invention.

The above described embodiment can be also adopted to an FED with a rib-type spacer as shown in FIG. 7.

FIG. 7 is a view showing cells disposed around a rib-type spacer in accordance with a first embodiment of the present invention;

As shown in FIG. 7, in the FED, the size of cells (R1, G1, B1, R2, G2 and B2) adjacent to the rib-type spacer 701 is set smaller than the size of cells (R, G and B) not adjacent to the rib-type spacer 701.

In other words, since the cells (R, G and B) not adjacent to the rib-type spacer 701 are formed larger than the conventional cells, the luminance and the aperture rate of the FED can be improved.

Meanwhile, in the above-described embodiment, the luminance of cells adjacent to the spacers 601 and 701 is lower than the luminance of other cells. In order to overcome the shortcomings, the present invention uses the following driving method.

Figure 8:
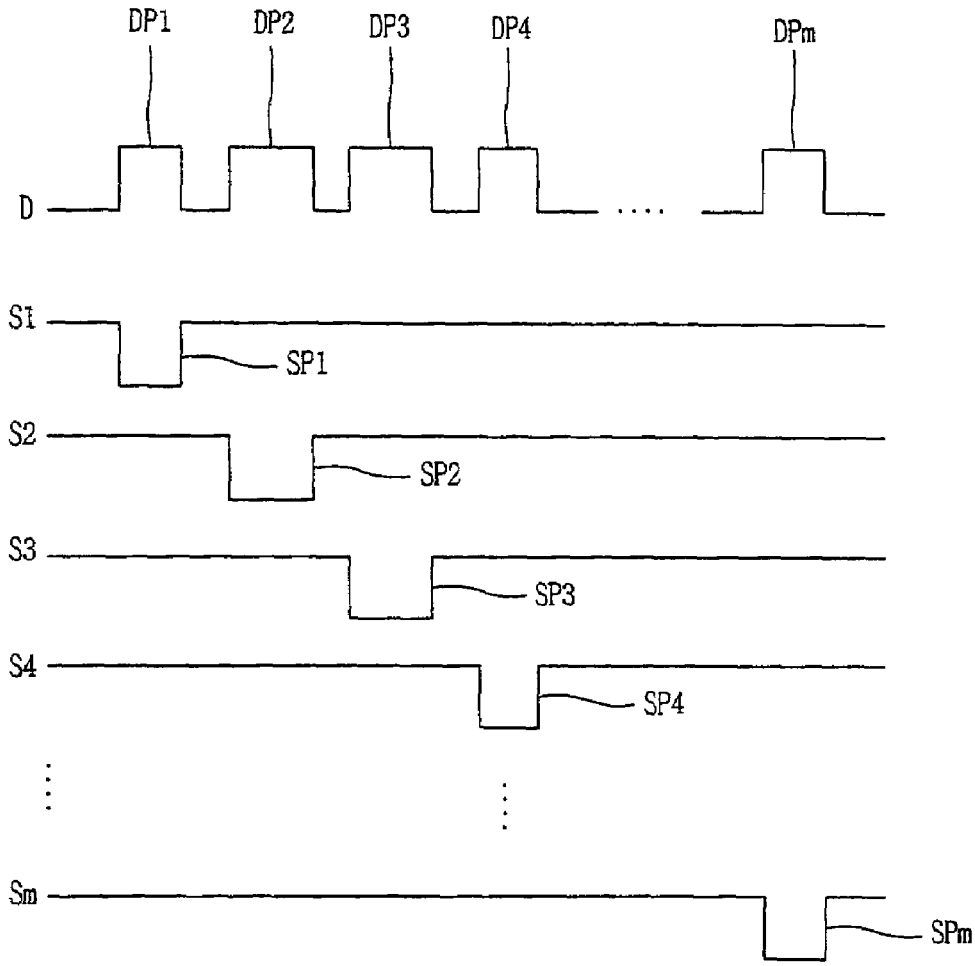
FIG. 8 is a view showing waveforms according to a driving of a field emission display device in accordance with the first embodiment of the present invention.

FIG. 8 is a view showing waveforms of a driving method of a field emission display device in accordance with the first embodiment of the present invention.

As shown in FIG. 8, in the driving method of the FED, scan pulses (SP1 and SP2) are sequentially supplied to the scan lines (S1, S2, . . . , Sm) and data pulses (DP1 and DP2) in synchronization with the scan pulses (SP1 and SP2) are supplied to the data electrodes (D).

At this time, certain electrons are emitted from the cell to which the scan pulses (SP1 and SP2) and the data pulses (DP1 and DP2) have been supplied, and the emitted electrons are accelerated by the anode electrode to display a certain image on the FED panel.

The first embodiment of the present invention will now be described in detail.

On the assumption that the rib-type spacer is installed between the second scan line (S2) and the third scan line (S3), the width of the scan pulse supplied to the scan lines (S2, S3) adjacent to the spacer is set larger than the width of the scan pulse supplied to the scan lines (S1 and S4) not adjacent to the spacer.

Likewise, the width of the second and third data pulses (DP2 and DP3) supplied to be synchronized with the second and third scan pulses (SP2 and SP3) is set larger than the width of the first and fourth data pulses (DP1 and DP4) supplied to be synchronized with the first and fourth scan pulses (SP1 and SP4).

In this manner, by supplying the scan pulse with the large width to the scan lines (S2 and S3) adjacent to the spacer, the calls can generate high luminance.

At the same time, the scan pulse and data pulse are set to have a larger width so that the cells not adjacent to the spacer and the cells adjacent to the spacer can have the same luminance.

Figure 9:
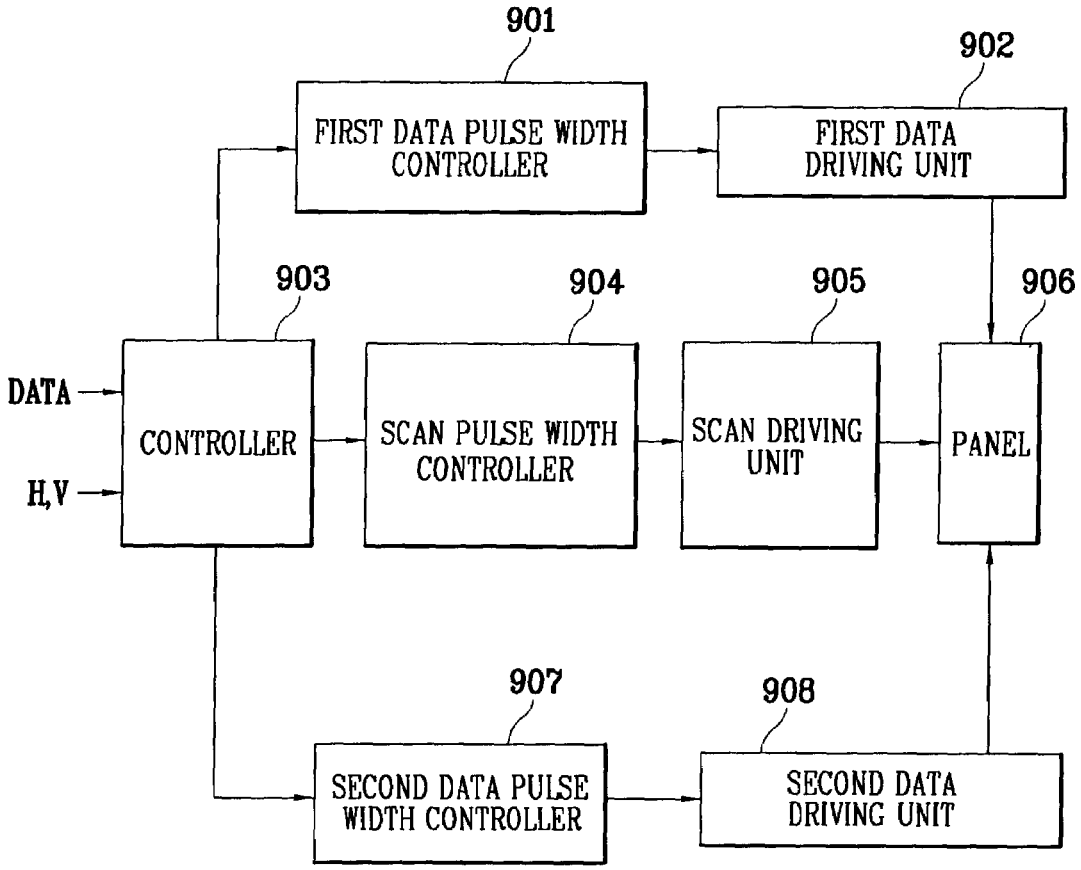
FIG. 9 is a view showing a driving apparatus of a flat-type field emission display device in accordance with the first embodiment of the present invention.

FIG. 9 is a view showing a driving apparatus of a flat-type field emission display device in accordance with the first embodiment of the present invention.

As shown in FIG. 9, the driving apparatus of a flat-type field emission display device includes: a controller 903 for receiving a data, a vertical synchronous signal and a horizontal synchronous signal from an external source and generating first and second timing control signal; first and second data pulse width controllers 901 and 907 for receiving the data and the first timing control signal from the controller 903 and generating first and second data pulse with mutually different widths; a scan pulse width controller 904 for receiving the second timing control signal from the controller 903 and generating first and second scan pulses with mutually different widths; first and second data driving units 902 and 908 for receiving the data pulse from the first and second data pulse width controllers 901 and 907 and applying it to a panel of the FED; and a scan driving unit 905 for receiving a scan pulse from the scan pulse width controller 904 and applying it to the panel 906.

The driving method of the field emission display device constructed as described above will now be explained in detail.

First, the controller 903 receives a data, a horizontal synchronous signal and a vertical synchronous signals from an external source, rearranges data according to a resolution of the panel, generates various timing control signals, and supplies them to the first and second data pulse width controllers 901 and 907 and the scan pulse width controller 904.

Then, the scan pulse width controller 904 sets the width of the scan pulse supplied to the scan lines adjacent to the spacer larger than the width of the scan pulse supplied to the scan lines not adjacent to the spacer and supplies the pulse with the large width to the scan driving unit 905, and the scan driving unit 905 applies the same to the panel 906.

The first and second data pulse width controllers 901 and 907 supply data pulses in synchronization with the scan pulse supplied to the scan lines adjacent to the spacer to the first and second data driving units 902 and 908.

At this time, the first and second data pulse width controllers 901 and 907 set the width of the data pulse supplied to the scan line adjacent to the spacer larger than the width of the data pulse supplied to the scan line not adjacent to the spacer.

Then, the first and second data driving units 902 and 908 supply a certain data pulse to the panel 906 in response to the data and the timing control signal supplied from the first and second data pulse width controllers 901 and 907, so that the luminance of the cells positioned adjacent to the spacers can be maintained the same as that of other cells.

Figure 10:
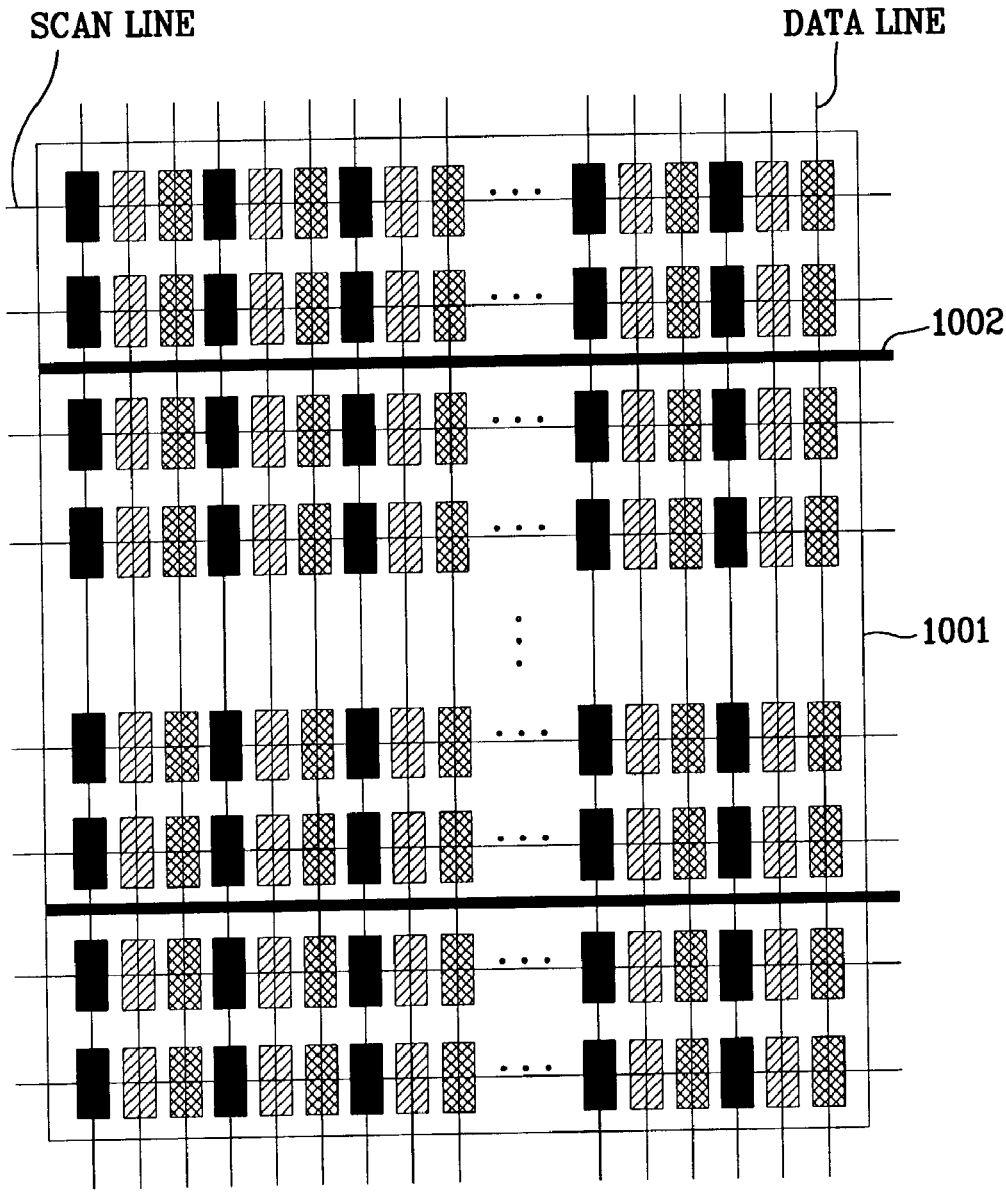
FIG. 10 is a view showing an effective display part in accordance with a second embodiment of the present invention.

FIG. 10 is a view showing an effective display part in accordance with a second embodiment of the present invention.

As shown in FIG. 10, red cells, green cells and blue cells are sequentially disposed at an effective display part 1001, and a spacer is formed between the cells.

In the region not adjacent to the spacer 1002 of the effective display part 1001, each cell is extended nearer to the adjacent cell and formed up to a portion of the region where a spacer 1001 is formed.

That is, by increasing a fluorescent material area of the cell up to the region where the spacer is formed, the cell can be set larger than that of the conventional art.

Meanwhile, the area of the cell adjacent to the spacer 1001 is set a bit larger than the area of the conventional cell. That is, by increasing the fluorescent material area of the cells adjacent to the spacer to a certain size (larger than the area of the conventional art), the luminance of the panel can be maintained constantly.

In this manner, in the effective display part 1001, the fluorescent material area of the cells other than the cells adjacent to the spacer 1002 is increased up to the region where the spacer 1002 is formed. Thus, though the fluorescent material area of the cells adjacent to the spacer 1002 is a bit increased compared with the fluorescent material area of the conventional cells depending on the existence of nonexistence of the spacer 102, the fluorescent material of the cells not adjacent to the spacer has an aperture area increased double the fluorescent material area of the conventional cells. In this respect, the aperture area is the fluorescent material area and an emitter area (not shown, from which electrons are emitted).

Figure 11:
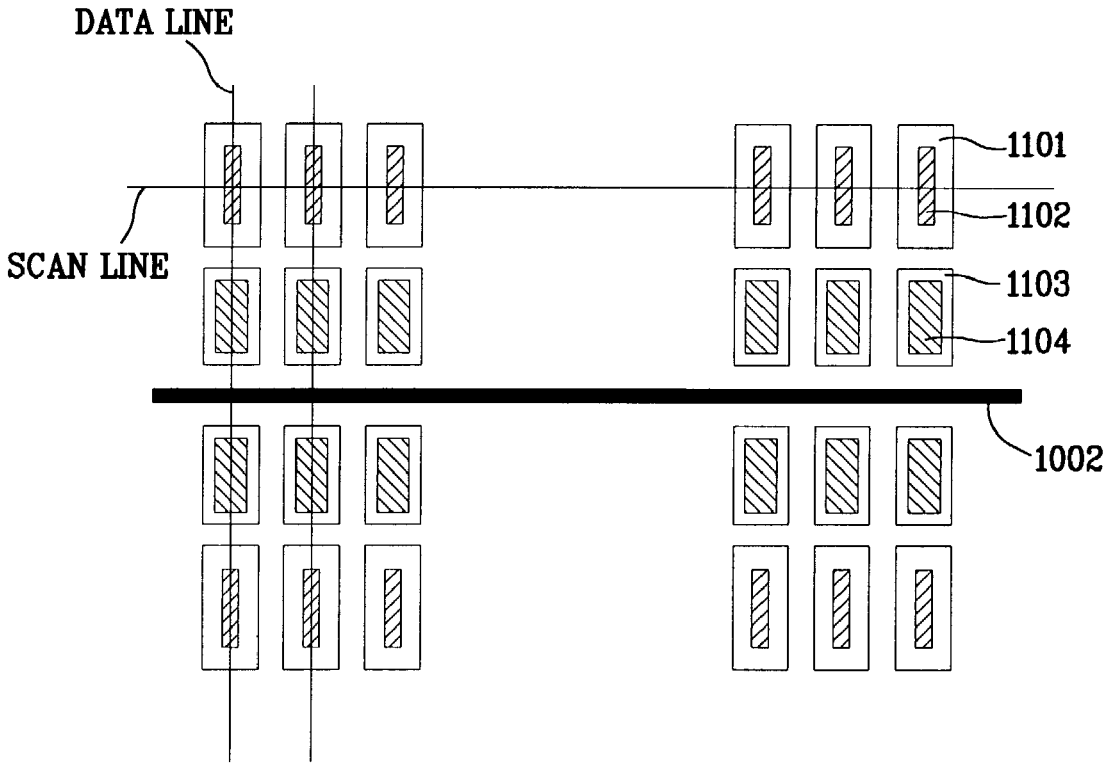
FIG. 11 is a view showing the effective display part in detail of FIG. 10.

FIG. 11 is a view showing the effective display part in detail of FIG. 10.

As shown in FIG. 11, in the effective display part 1001, the fluorescent material area 1103 of the cells adjacent to the spacer 1002 is smaller than the fluorescent material area 1101 of the cells not adjacent to the spacer 1002.

In this respect, however, since the emitter area 1104 of the cells adjacent to the spacer 1002 is larger than the emitter area 1102 of the cells not adjacent to the spacer, more electrons are emitted.

Therefore, the amount of electrons emitted from the cells adjacent to the spacer 1002 is greater than the amount of electrons emitted from the cells not adjacent to the spacer 1002, the luminance of the overall panel is uniform.

As a result, in order to compensate the reduced size of cells adjacent to the spacer 1002, the electron emission area of the emitter is enough obtained, so that the balance of the overall brightness can be maintained.

Accordingly, the aperture rate of the general field emission display device is about 30%, and the cell structure of the embodiment of the present invention obtains an aperture rate of above 50%, resulting in that an efficiency and brightness of the field emission display device can be improved and a power consumption can be reduced.

As so far described, the flat type field emission display device and its driving method has the following advantages.

That is, for example, since the size of the cells adjacent to the spacer is set smaller than the size of the other cells, the luminance and aperture rate of the panel can be improved.

In addition, the width of the pulse supplied to the cells adjacent to the spacer and the width of the pulse supplied to the cells not adjacent to the spacer are set different, so that every cell can have the same luminance.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such metes and bounds are therefore intended to be embraced by the appended claims.

What is claimed is:

1. A field emission display device, comprising:

a plurality of cells having different size display areas, respectively, formed at an effective display part of a panel; and a spacer formed between a portion of the cells, wherein an area of an emitter of each cell adjacent to the spacer is larger than an area of an emitter of each cell not adjacent to the spacer.

2. The device of claim 1, wherein an area of a cell not adjacent to the spacer is larger than a cell adjacent to the spacer.

3. The device of claim 1, wherein areas of a fluorescent material of the plurality of cells are different depending on a position of the spacer.

4. The device of claim 1, wherein the plurality of cells include a first set of cells each having a fluorescent material of a first area and a second set of cells each having a fluorescent material of a second area larger than the first area.

5. The device of claim 1, wherein an area of a fluorescent material of cells adjacent to the spacer is smaller than an area of a fluorescent material of cells not adjacent to the spacer.

6. The device of claim 1, wherein a space between cells adjacent to the spacer is larger than a space between cells not adjacent to the spacer.

7. The device of claim 1, wherein the plurality of cells include a first set of cells each having an emitter electrode of a first area and a second set of cells each having an emitter electrode of a second area larger than the first area.

8. The device of claim 1, wherein an area of a fluorescent material and an area of the emitter of the plurality of cells are set different according to a position of the spacer.

9. The device of claim 8, wherein an area of the emitter of a cell adjacent to the spacer is larger than an area of an emitter of a cell not adjacent to the spacer, and an area of a fluorescent material of a cell adjacent to the spacer is smaller than an area of a fluorescent material of a cell not adjacent to the spacer.

* * * * *